US010188257B2

(12) United States Patent
Pelayo

(10) Patent No.: US 10,188,257 B2
(45) Date of Patent: Jan. 29, 2019

(54) CEILING TEXTURE SCRAPING ASSEMBLY

(71) Applicant: Sergio Pelayo, Temecula, CA (US)

(72) Inventor: Sergio Pelayo, Temecula, CA (US)

( * ) Notice: Subject to any disclaimer, the term of this patent is extended or adjusted under 35 U.S.C. 154(b) by 195 days.

(21) Appl. No.: 15/211,318

(22) Filed: Jul. 15, 2016

(65) Prior Publication Data

US 2018/0014710 A1 Jan. 18, 2018

(51) Int. Cl.

| | |
|---|---|
| ***A47L 13/08*** | (2006.01) |
| ***B44D 3/16*** | (2006.01) |
| *A47L 13/52* | (2006.01) |
| *B25G 3/36* | (2006.01) |

(52) U.S. Cl.

CPC ..... *A47L 13/08* (2013.01); *B44D 3/162* (2013.01); *B44D 3/164* (2013.01); *A47L 13/52* (2013.01); *B25G 3/36* (2013.01)

(58) Field of Classification Search

CPC ..... B44D 3/16; B44D 3/162; B44D 3/164; A47L 13/08; A47J 17/02

USPC ..... 15/257.1, 257.2, 257.9, 236.01; 30/169

See application file for complete search history.

(56) References Cited

U.S. PATENT DOCUMENTS

| | | | | |
|---|---|---|---|---|
| 670,935 | A | 4/1901 | Martelli | |
| 822,605 | A | 6/1906 | Henninger | |
| 890,449 | A * | 6/1908 | Petteway et al. | B44D 3/162 30/136 |
| 1,211,441 | A * | 1/1917 | Ham | B44D 3/162 15/236.01 |
| 3,665,605 | A * | 5/1972 | Howerter | B44D 3/164 30/169 |
| D424,767 | S | 5/2000 | Shea | |
| 6,101,663 | A | 8/2000 | Greer, Jr. et al. | |
| 7,814,609 | B1 | 10/2010 | Shumway | |
| 8,108,966 | B1 | 2/2012 | Viviano | |
| 2009/0188920 | A1 | 7/2009 | Momberger | |

* cited by examiner

*Primary Examiner* — Laura C Guidotti

(57) ABSTRACT

A ceiling texture scraping assembly includes a pan that may be manipulated having the pan being positioned beneath a ceiling. A plurality of fasteners is provided. Each of the fasteners extends through an associated one of the tabs and engaging an associated one of the lateral walls. Thus, each of the lateral walls is coupled to the outer wall. A sleeve is coupled to and extends away from the pan and the sleeve may be gripped. A blade is coupled to the pan. The blade frictionally engages texture on the ceiling. Thus, the blade to removes the texture from the ceiling.

7 Claims, 4 Drawing Sheets

CEILING TEXTURE SCRAPING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to scraping devices and more particularly pertains to a new scraping device for scraping popcorn texture from a ceiling.

BRIEF SUMMARY OF THE INVENTION

An embodiment of the disclosure meets the needs presented above by generally comprising a pan that may be manipulated having the pan being positioned beneath a ceiling. A plurality of fasteners is provided. Each of the fasteners extends through an associated one of the tabs and engaging an associated one of the lateral walls. Thus, each of the lateral walls is coupled to the outer wall. A sleeve is coupled to and extends away from the pan and the sleeve may be gripped. A blade is coupled to the pan. The blade frictionally engages texture on the ceiling. Thus, the blade to removes the texture from the ceiling.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
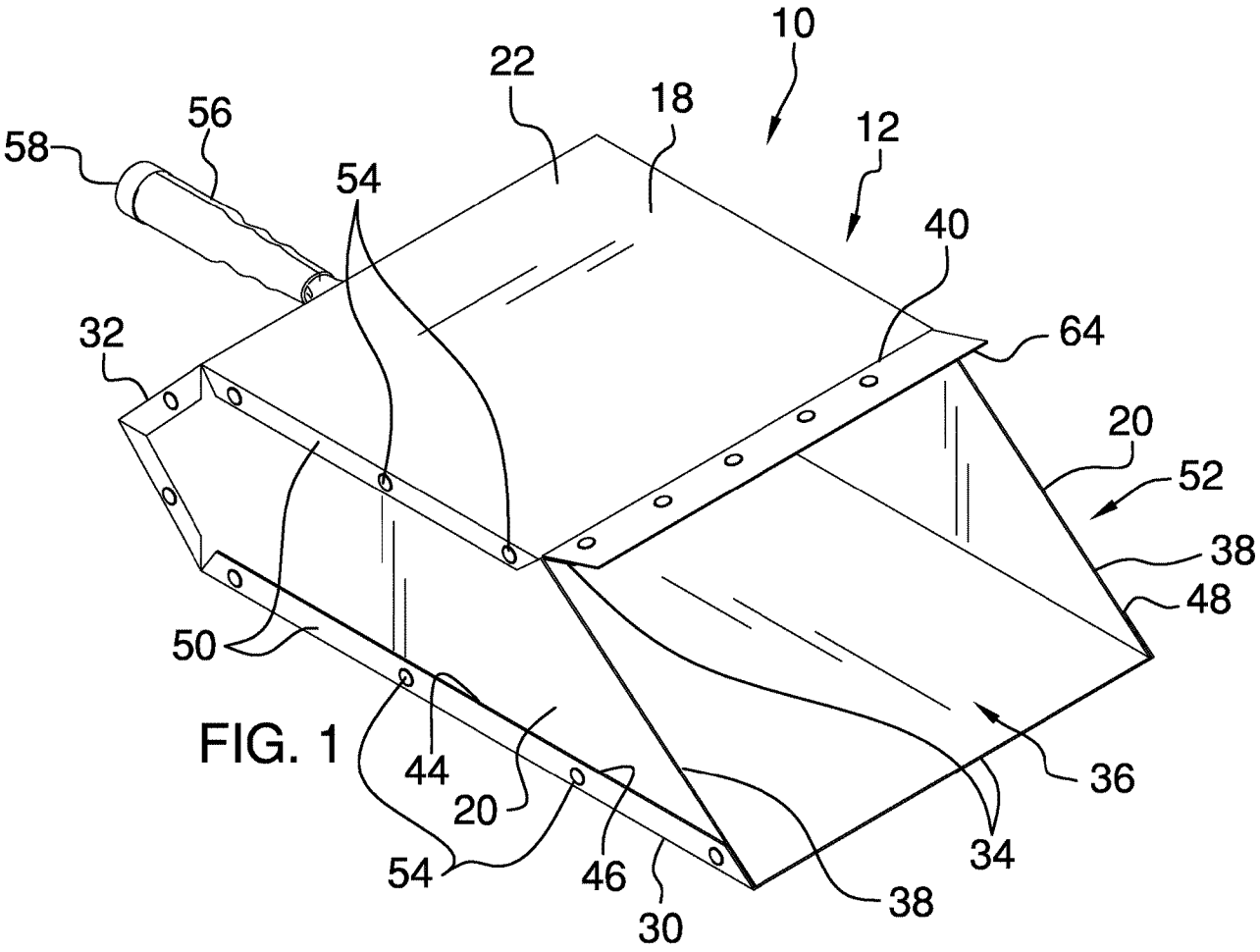
FIG. 1 is a perspective view of a ceiling texture scraping assembly according to an embodiment of the disclosure.
Figure 2:
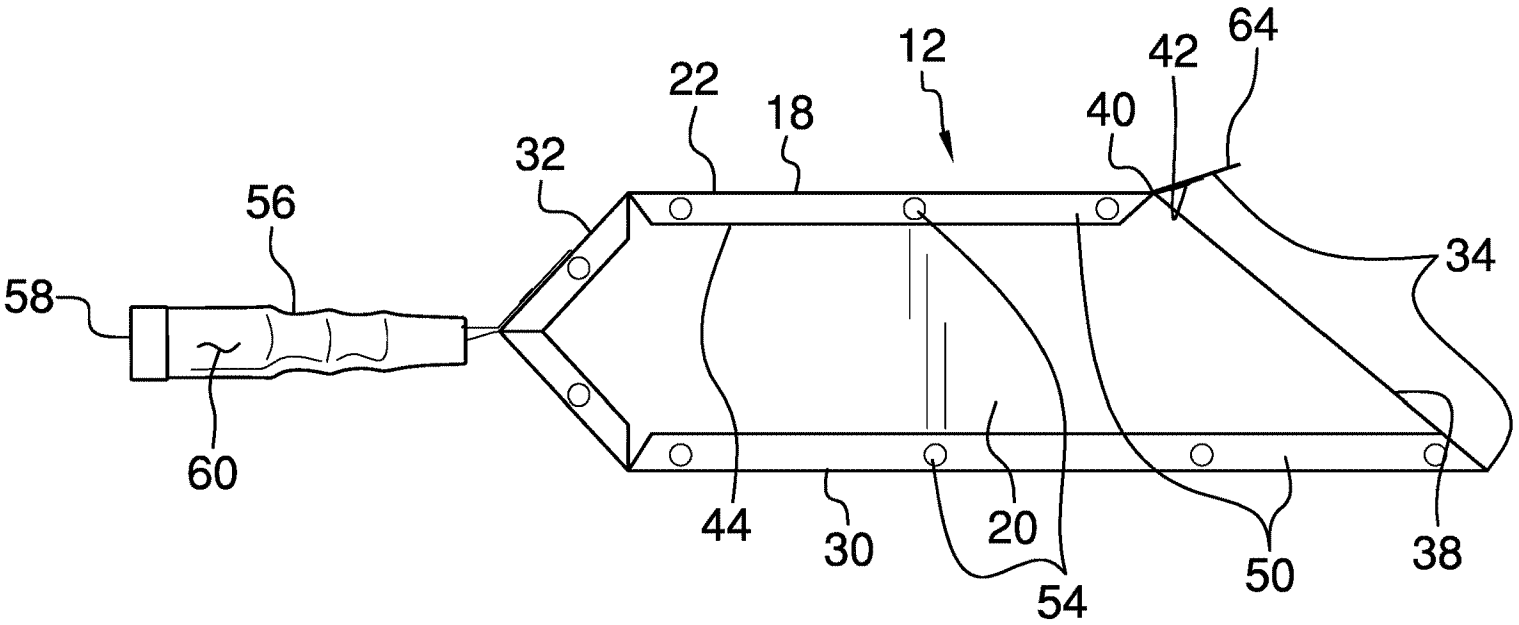
FIG. 2 is a right side view of an embodiment of the disclosure.
Figure 3:
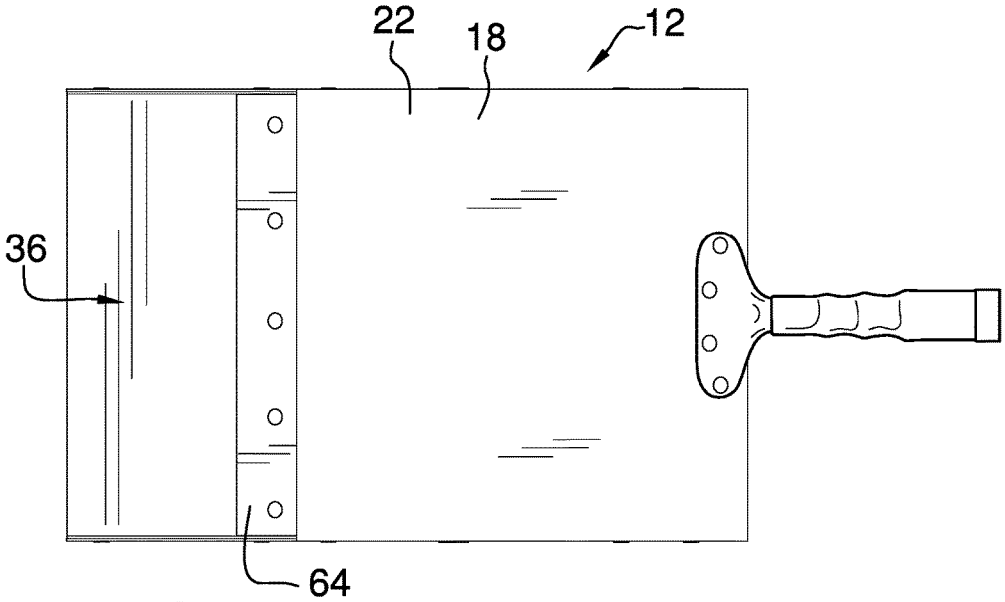
FIG. 3 is a top view of an embodiment of the disclosure.
Figure 4:
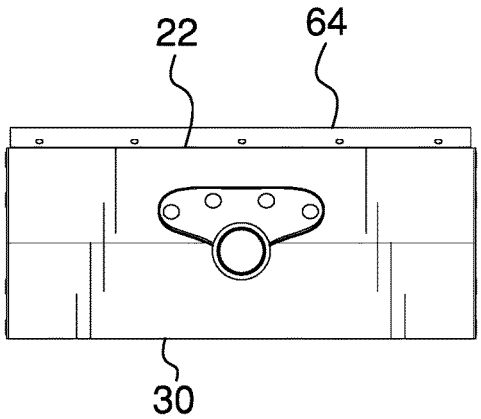
FIG. 4 is a back view of an embodiment of the disclosure.
Figure 5:
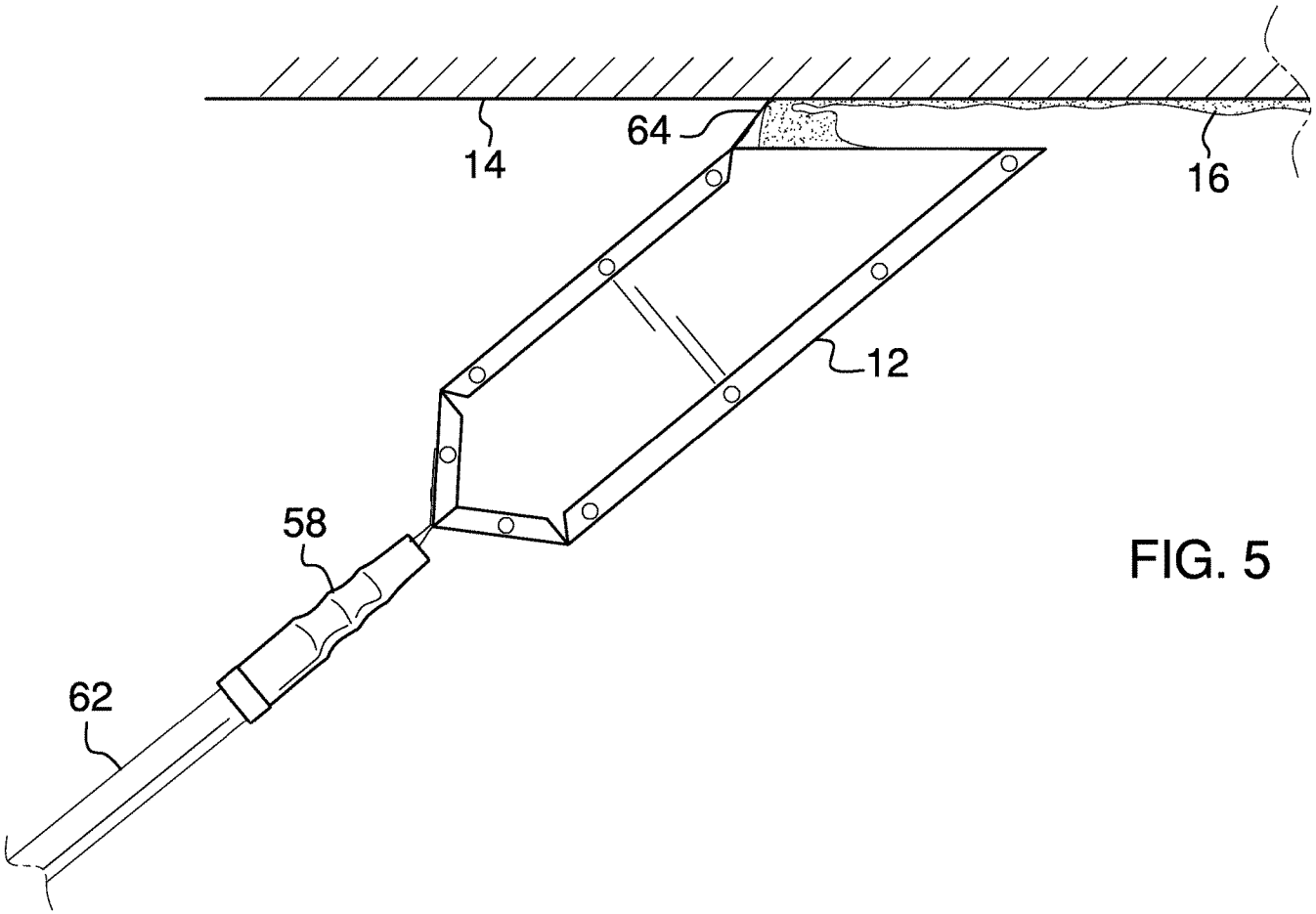
FIG. 5 is a perspective in-use view of an embodiment of the disclosure.

With reference now to the drawings, and in particular to FIGS. 1 through 5 thereof, a new scraping device embodying the principles and concepts of an embodiment of the disclosure and generally designated by the reference numeral 10 will be described.

As best illustrated in FIGS. 1 through 5, the ceiling texture scraping assembly 10 generally comprises a pan 12 that may be manipulated having the pan 12 being positioned beneath a ceiling 14. The ceiling 14 may be a ceiling 14 in a room or the like. Moreover, the ceiling 14 may be comprised of textured sheetrock. A texture 16 on the sheetrock may be popcorn texture or the like.

The pan 12 has an outer wall 18 and a pair of peripheral walls 20. The outer wall 18 has a top side 22, a bottom side 30 and a back side 32. The back side 32 tapers to a point between each of the bottom side 30 and the back side 32. Each of the top side 22 and the bottom side 30 has a distal edge 34 with respect to the back side 32. The distal edge 34 corresponding to each of the top side 22 and the bottom side 30 defines an opening 36 into the pan 12. Thus, the opening 36 may receive the texture 16 from the ceiling 14.

The bottom side 30 has a length that is greater than a length of the top side 22. Each of the peripheral walls 20 has a leading edge 38. The leading edge 38 angles between the distal edge 34 of corresponding to each of the top side 22 and the bottom side 30. The top side 22 has a first bend 40 thereon. The first bend 40 is spaced from and is coextensive with the distal edge 34 of the top side 22. Thus, the first bend 40 defines a lip 42 angling upwardly from the top side 22.

The outer wall 18 has a peripheral edge 44. The peripheral edge 44 has a first side 44 and a second side 46. The outer wall 18 has a pair of second bends 48 thereon. Each of the second bends 48 is spaced from and is coextensive with an associated one of the first side 44 and the second side 46. Thus, each of the second bends 48 defines an associated one of pair of tabs 50. Each of the tabs 50 extends inwardly toward a center 52 of the pan 12. Each of the peripheral walls extends between the top side 22 and the bottom side 30. Moreover, each of the peripheral walls 20 abuts an associated on of the tabs 50.

A plurality of fasteners 54 is provided. Each of the fasteners 54 extends through an associated one of the tabs 50 and engages an associated one of the peripheral walls 20. Thus, each of the peripheral walls 20 is coupled to the outer wall 18. Each of the fasteners 54 may comprise a rivet or the like.

A sleeve 56 is provided. The sleeve 56 is coupled to and extends away from the pan 12 and the sleeve 56 may be gripped. Te sleeve 56 is positioned on the back side 32. The sleeve 56 has a distal end 58 with respect to the back side 32 and the distal end 58 is open. The sleeve 56 has an outer surface 60. The outer surface 60 undulates between the pan 12 and the distal end 58 of the sleeve 56. Thus, the outer surface 60 enhances gripping the sleeve 56.

A pole 62 is provided. The pole 62 is selectively positioned in the distal end 58 of the sleeve 56. The pole 62 may threadably engage the sleeve 56. Thus, the pole 62 is removably coupled to the pan 12 to facilitate the pan 12 to be positioned on the ceiling 14. The pole 62 increases a reach of the pan 12.

A blade 64 is provided. The blade 64 is coupled to the pan 12. The blade 64 frictionally engages the texture 16 on the ceiling 14 when the pan 12 is manipulated. Thus, the blade 64 may remove the texture 16 from the ceiling 14. The blade 64 is coextensively positioned on the tab.

In use, the pole 62 is coupled to the sleeve 56 and the pole 62 is manipulated to position the pan 12 on the ceiling 14. The pan 12 is manipulated such that the blade 64 engages the ceiling 14 having the opening 36 in the pan 12 being positioned beneath the ceiling 14. The pan 12 is urged along the ceiling 14 thereby facilitating the blade 64 to scrape the texture 16 from the ceiling 14. The texture 16 falls into the opening 36 in the pan 12 when the texture 16 is scraped from the ceiling 14. The pan 12 is emptied when the texture 16 fills the pan 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ceiling texture scraping assembly being configured to scrape and collect texture from a ceiling, said assembly comprising:

a pan being configured to be manipulated having said pan being positioned beneath a ceiling, said pan having an outer wall and a pair of peripheral walls, said outer wall having a top side, a bottom side and a back side, said back side tapering to a point extending away from each of said bottom side and said top side, each of said top side and said bottom side having a distal edge with respect to said back side, said distal edge corresponding to each of said top side and said bottom side defining an opening into said pan wherein said opening is configured to receive texture from the ceiling, said bottom side having a length being greater than a length of said top side;

a sleeve being coupled to and extending away from said point parallel to said top side and said bottom side wherein said sleeve is configured to be gripped; and a blade being coupled to said pan wherein said blade is configured to frictionally engage texture on the ceiling thereby facilitating said blade to remove the texture from the ceiling.

2. The assembly according to claim 1, wherein said top side has a first bend thereon, said first bend being spaced from and being coextensive with said distal edge of said top side such that said first bend defines a lip angling upwardly from said top side.

3. The assembly according to claim 1, wherein said outer wall has a peripheral edge, said peripheral edge having a first side and a second side, said outer wall having a pair of second bends thereon, each of said second bends being spaced from and being coextensive with an associated one of said first side and said second side such that each of said second bends defines an associated one of pair of tabs, each of said tabs extending inwardly toward a center of said pan, each of said lateral walls extending between said top side and said bottom side having each of said lateral walls abutting an associated one of said tabs.

4. The assembly according to claim 3, further comprising a plurality of fasteners, each of said fasteners extending through an associated one of said tabs and engaging an associated one of said lateral walls such that each of said lateral walls is coupled to said outer wall.

5. The assembly according to claim 1, wherein said sleeve is positioned on said back side, said sleeve having a distal end with respect to said back side, said distal end being open.

6. The assembly according to claim 5, further comprising a pole being selectively positioned in said distal end of said sleeve such that said pole is removably coupled to said pan wherein said pan is configured to be positioned on the ceiling.

7. A ceiling texture scraping assembly being configured to scrape and collect texture from a ceiling, said assembly comprising:

a pan being configured to be manipulated having said pan being positioned beneath a ceiling, said pan having an outer wall and a pair of peripheral walls, said outer wall having a top side, a bottom side and a back side, said back side tapering to a point extending away from each of said bottom side and said top side, each of said top side and said bottom side having a distal edge with respect to said back side, said distal edge corresponding to each of said top side and said bottom side defining an opening into said pan wherein said opening is configured to receive texture from the ceiling, said bottom side having a length being greater than a length of said top side, said top side having a first bend thereon, said first bend being spaced from and being coextensive with said distal edge of said top side such that said first bend defines a lip angling upwardly from said top side, said outer wall having a peripheral edge, said peripheral edge having a first side and a second side, said outer wall having a pair of second bends thereon, each of said second bends being spaced from and being coextensive with an associated one of said first side and said second side such that each of said second bends defines an associated one of pair of tabs, each of said tabs extending inwardly toward a center of said pan, each of said lateral walls extending between said top side and said bottom side having each of said lateral walls abutting an associated one of said tabs;

a plurality of fasteners, each of said fasteners extending through an associated one of said tabs and engaging an associated one of said lateral walls such that each of said lateral walls is coupled to said outer wall;

a sleeve being coupled to and extending away from said point parallel to said top side and said bottom side wherein said sleeve is configured to be gripped, said sleeve being positioned on said back side, said sleeve having a distal end with respect to said back side, said distal end being open;

a pole being selectively positioned in said distal end of said sleeve such that said pole is removably coupled to said pan wherein said pan is configured to be positioned on the ceiling; and a blade being coupled to said pan wherein said blade is configured to frictionally engage texture on the ceiling thereby facilitating said blade to remove the texture from the ceiling, said blade being coextensively positioned on said tab.

* * * * *